United States Patent [19]

Pridy

[11] 4,131,005

[45] Dec. 26, 1978

[54] TUBULAR MEMBER STRAIGHTENING, DESCALING AND HYDRAULIC TESTING APPARATUS

[76] Inventor: Whetstine B. Pridy, 861 Stevely, Long Beach, Calif. 90815

[21] Appl. No.: 798,819

[22] Filed: May 20, 1977

[51] Int. Cl.[2] ..... B21D 7/04; B21D 43/00

[52] U.S. Cl. ..... 72/40; 29/81 F; 72/389

[58] Field of Search ..... 29/81 A, 81 F, 81 G; 72/39, 40, 389

[56] References Cited

U.S. PATENT DOCUMENTS

| | | | |
|---|---|---|---|
| 1,879,009 | 9/1932 | Anthony | 29/81 F |
| 1,951,066 | 3/1934 | Shelly | 29/81 F |
| 2,996,789 | 8/1961 | Pridy | 29/81 A |
| 3,446,054 | 5/1969 | Pridy | 72/389 |

*Primary Examiner*—E. M. Combs

*Attorney, Agent, or Firm*—William C. Babcock

[57] ABSTRACT

An apparatus and method of using the same to sequentially subject tubular members such as oil well tubing, drill pipe and the like from a stack thereof to a sequence of operations in which each tubular member while mounted in the apparatus is straightened, has rust and foreign material removed from the external surface thereof, has solid foreign material removed from the interior thereof, and the tubular member after being straightened and descaled being subjected to hydraulic testing at a desired magnitude. The apparatus is preferably wheel supported to permit it to be moved adjacent stacked pipe in the field. However, should it be desired, the apparatus may be mounted on skids and the like or other suitable base, and used at a stationary position either adjacent to or at a distance from stacked tubular members.

13 Claims, 20 Drawing Figures

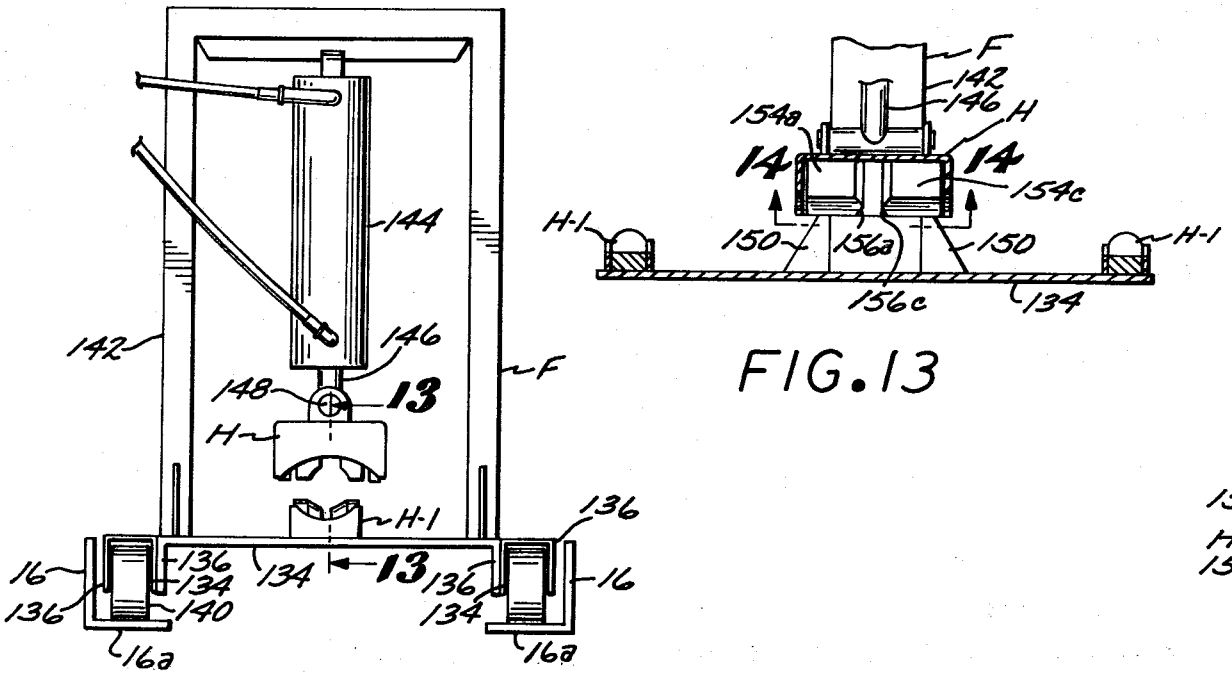
FIG. 12
FIG. 13
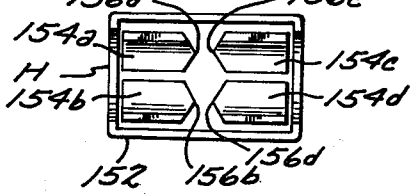
FIG. 14
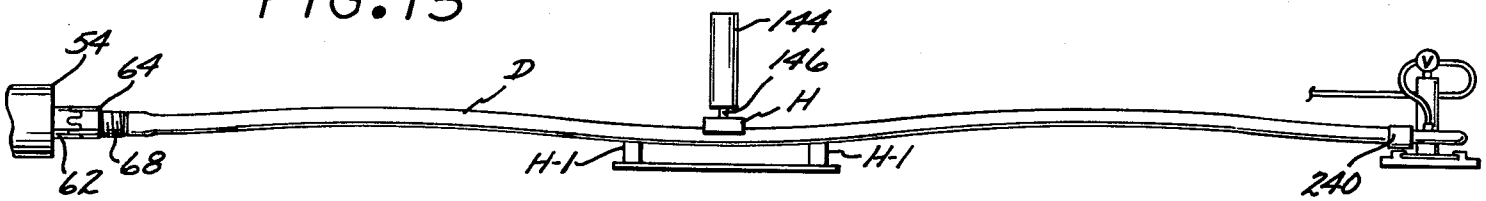
FIG. 15

FLUID RESERVOIR
ENGINE
TRANS-MISSION
WATER RESERVOIR 20
20

TUBULAR MEMBER STRAIGHTENING, DESCALING AND HYDRAULIC TESTING APPARATUS

CROSS-REFERENCE TO RELATED APPLICATIONS

The present apparatus and method of using the same is an improvement on the invention shown and claimed in my U.S. Pat. No. 3,446,054, entitled, "Apparatus for Straightening Elongate Tubular Members," that issued on May 27, 1969.

BACKGROUND OF THE INVENTION

1. Field of the Invention

Tubular Member Straightening, Descaling and Hydraulic Testing Apparatus.

2. Description of the Prior Art

In oil fields, drill pipe and oil well tubing becomes bent and deformed for a variety of reasons. Oil well tubing when situated in a well is subject to a hostile environment that results in the exterior surface thereof becoming rusted and corroded. Also, as fluid flows through the tubing, foreign material is deposited on the interior thereof, either in a waxy form or as a hard scale. This foreign material in the interior of the tubing, irrespective of its physical characteristics, lessens the transverse area in the interior of the tubing and tends to restrict the flow of fluid therethrough. Whether tubing is serviceable for future use cannot be determined visually after foreign materials are removed from the exterior and interior surfaces thereof, for pitting by corrosion may be so deep that it has practically penetrated the full wall thickness of the tubing. Serviceability of tubing may be determined by hydraulically testing the interior of the tubing at a substantial pressure, from five thousand pounds per square inch on up. Tubing that has cracks or fissures therein or is seriously corroded will normally leak or blow out at such hydraulic pressure and will be discarded for further use in a well.

In the past, the above steps have been performed individually, particularly the hydraulic testing, but not in combination on a single apparatus.

A major object of the present invention is to provide a single apparatus and method of using the same on which a tubular member may be removably disposed to be subjected to a sequence of operations in which the tubular member has foreign material removed both from the exterior and interior thereof, is straightened, is hydraulically tested, and with the threads of the tubular member cleaned of foreign material.

Yet another object of the invention is to provide an apparatus and method of using the same for the reconditioning of tubular members, and the segregation of serviceable tubular members from unserviceable ones thereof.

A still further object of the invention is to supply an apparatus and method of using the same in which hard material deposited as a layer in a tubular member, or a cement core in the tubular member is fractured by sequentially transversely deforming sections of the tubular member and then reaming the hard deposited material or cement from the tubular member prior to hydraulically testing the latter, with the transverse deforming sections preferably being carried out to the extent that the tubular member is straightened.

Another object of the invention is to provide an apparatus and method of using the same to both straighten and remove foreign material from the interior and exterior of a metallic tubular member without raising the temperature of the tubular member to the extent that the physical properties of the metal defining the same will be impaired.

SUMMARY OF THE INVENTION

The apparatus is illustrated as including first and second wheeled vehicles that are axially aligned and may be moved from place to place as a unit. The first vehicle includes movable power driven means to lift tubular members of different diameters to a position from which they roll to a centered longitudinal position on the first vehicle.

A power operated driving member on the first vehicle removably engages the tubular member when in the centered position to thereafter rotate the tubular member, with water at low pressure being discharged through the driving member into the tubular member to flow towards the rearward end thereof. As the tubular member rotates, power means move a carriage longitudinally on the first vehicle towards the rearward end thereof, with the carriage supporting a hydraulically operated ram that forces a first pressure pad downwardly onto the tubular member in a position intermediate two second pressure pads carried by the carriage and on which the tubular member rests. The first and second pressure pads cooperate as the supporting carriage moves rearwardly on the apparatus to concurrently straighten the tubular member and remove foreign material and rust from the exterior surface thereof by sequentially transversely deforming longitudinal sections of the tubular member.

As longitudinal sections of the tubular member are transversely deformed by pressure exerting pads supported on the carriage, hard scale that has been deposited in the tubular member, or a cement core that may be present in the interior of the tubular member is fractured. During the movement of the carriage on the first vehicle, a flow of low pressure water is maintained through the centered tubular member to prevent substantial heating of the tubular member during the straightening operation. The rearwardly flowing low pressure water also serves to carry reamed cuttings of foreign material from the interior of the tubular member to the rearward end thereof where they drop to the ground or into a suitable container.

After the hard foreign material in the tubular member has been fractured, the fractured material may be removed by advancing a reamer longitudinally through the tubular member, which reamer is supported on the second vehicle and moves longitudinally relative thereto.

After the tubular member has been straightened and foreign material removed from both the outside and inside thereof, the threads on the rearward end of the tubular member are cleaned by contact with a stiff brush. A movable fixture on the rearward end of the first vehicle is now placed in fluid tight engagement with the rearward end of the tubular member. Low pressure water continues to flow into the tubular member and substantially fills the same. High pressure water is now discharged into the tubular member from the fixture, and water in the tubular member being prevented from discharging therefrom by a check valve operatively associated with the driving member. A visually observable hydraulic gauge is in communication with the interior of the tubular member.

This high pressure water is discharged into the tubular member until the gauge indicates a predetermined pressure has been reached. Flow of high pressure water to the tubular member is now terminated, and the gauge observed to see if there is a drop in pressure. If there is a pressure drop this indicates that the tubular member leaks and is not serviceable for future use in an oil well. During the build up of hydraulic pressure in the tubular member, the tubular member may split or have a stream of water discharge through a hole therein, which of course without further testing indicates that the tubular member is not serviceable and should be discarded. After a tubular member is tested as above described, the tubular member is removed by power means from the apparatus and another tubular member mounted on the apparatus for testing.

BRIEF DESCRIPTION OF THE DRAWINGS

FIG. 12 is a front elevational view of the ram supporting carriage that is longitudinally movable on the first vehicle of the invention;

FIG. 13 is a fragmentary vertical cross sectional view of the carriage shown in FIG. 12 taken on the lines 13—13 thereof;

FIG. 14 is a bottom plan view of the pressure pad shown in FIG. 13 taken on the line 14—14 thereof;

FIG. 15 is a side elevational view of a tubular member having a portion intermediate the ends thereof that are transversely deformed by the ram to straighten the same as the tubular member rotates, and the driving head and the restraining guide for the free end of the tubular member being shown;

DESCRIPTION OF THE PREFERRED EMBODIMENT

Figure 1:
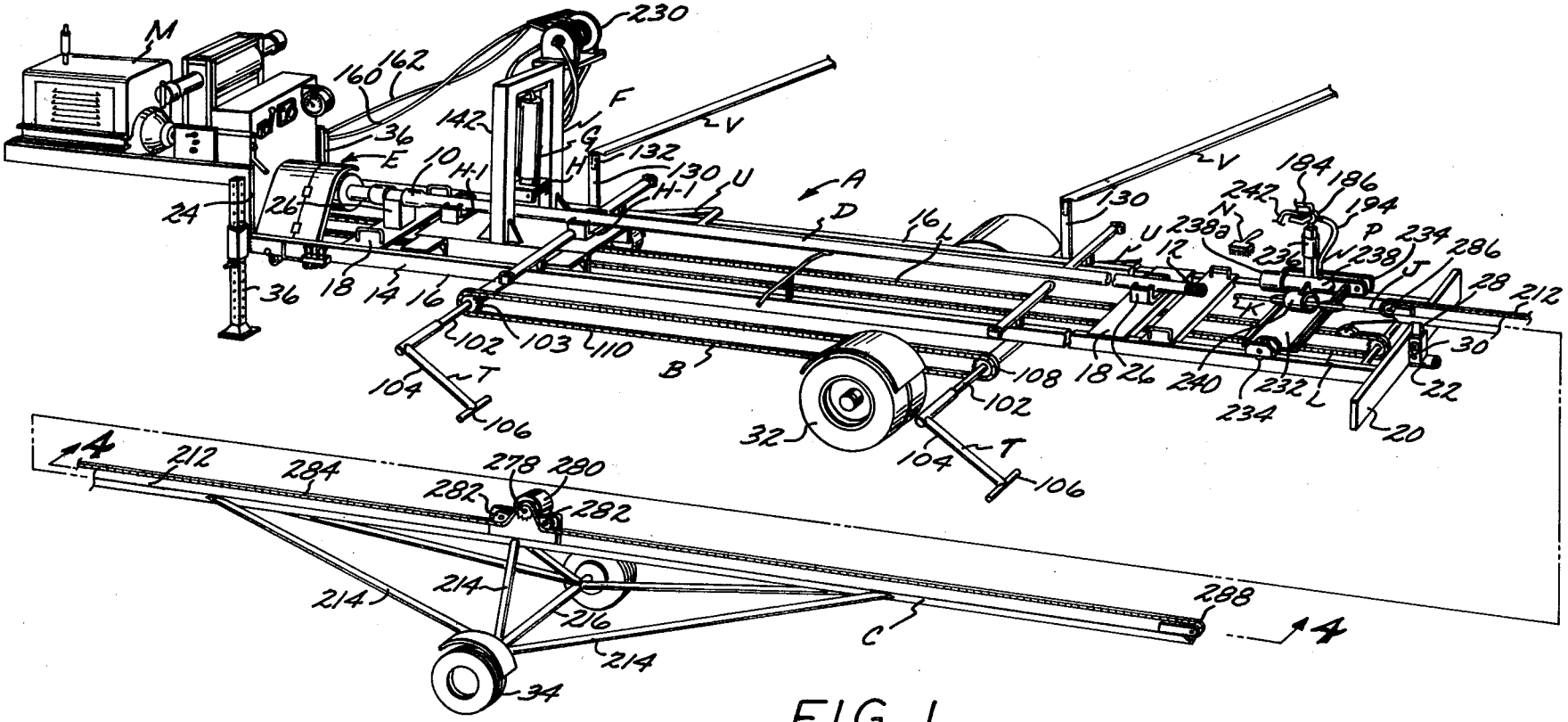
FIG. 1 is a perspective view of the apparatus of the present invention that includes a first vehicle that is capable of straightening a length of a tubular member when the latter is in a centered position thereon, removes rust and foreign material from the exterior surface thereof, hydraulically tests the tubular member to a desired pressure, have the threads on the ends of the tubular member cleaned and coated with a protective film of oil, and by the use of a second vehicle removably connected to the rearward end of the first vehicle, foreign material in the tubular member that has been fractured by the straightening operation is reamed from the tubular member.

The apparatus A of the present invention as illustrated in FIG. 1 includes a first vehicle B and a second vehicle C that is longitudinally aligned with the first vehicle and movably connected thereto. The first vehicle B is adapted to have a tubular member D, such as drill pipe, upset oil well tubing, or the like, removably disposed in a longitudinal centered position thereon to be rotated by a driving assembly E situated at the forward ends of the first vehicle. A carriage F is longitudinally movable on the first vehicle B, with the carriage F supporting a hydraulic assembly G that includes an upwardly disposed pressure pad H and a pair of longitudinally spaced pressure pads H-1, as may be seen in FIG. 1, that at least partially support the tubular member. The second vehicle B slidably supports an elongate rigid element J for longitudinal movement relative thereto, with the elongate element J on the forward end thereof supporting a reamer K. A first endless chair link belt L is rotatably supported in a longitudinal position on the first vehicle B, with the belt having the carriage F connected thereto. When the first belt L is rotated in an appropriate direction, it will be seen from FIG. 16 that the carriage F moves towards the rearward end of the first vehicle B.

During the rearward movement of the carriage F the hydraulic assembly G is actuated to sequentially transversely deform sections of the tubular member D as the latter rotates to not only straighten the tubular member but to fracture solid deposited foreign material within the interior thereof. The pressure pad F during the straightening operation is in frictional contact with the rotating tubular member D and the latter is heated as a result. Such heat is detrimental to the metal defining the tubular member D and is substantially eliminated by discharging a stream of cooling water from the driving assembly E rearwardly through the tubular member. This stream of water serves a second function that will later be described. After the tubular member D has been straightened, the threads on the rearward end of the tubular member D is cleaned as the tubular member rotates by being brought into contact with a brush N to remove rust and foreign material from the threads and the threads then being coated with a film of protective oil.

Figure 6:
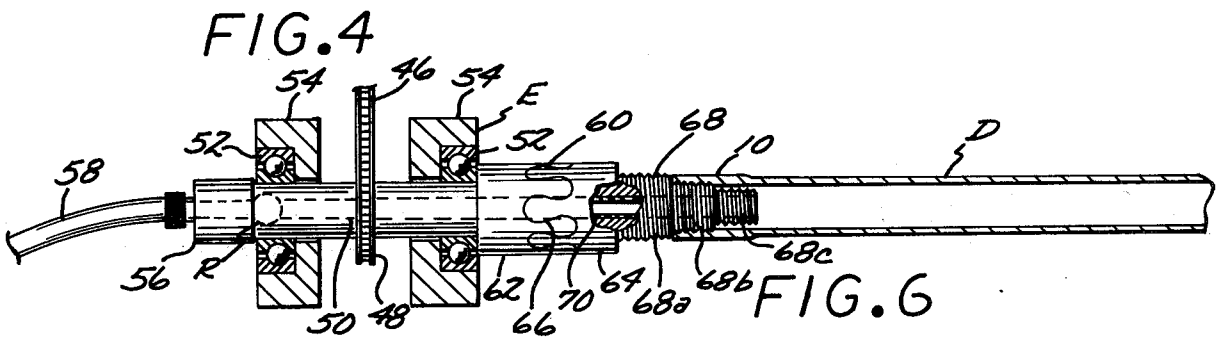
FIG. 6 is a fragmentary enlarged combined side elevational and longitudinal cross sectional view of a length of a tubular member in removable engagement with a power driven rotatable driving head through which water may be discharged into the interior of a tubular member during both the straightening and the descaling thereof.
Figure 7:
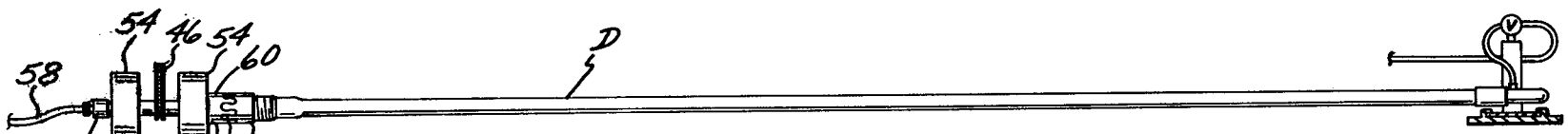
FIG. 7 is a side elevational view of the apparatus, illustrating a manner in which a length of tubing connected to the rotatable driving head shown in FIG. 6 may be engaged by a fixture mounted on the first vehicle to hydraulically test the tubular member to a desired pressure.
Figure 5:
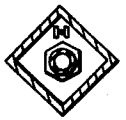
FIG. 5 is a transverse cross sectional view of the portion of the second vehicle shown in FIG. 18 taken on the line 5—5 thereof.

After foreign material has been removed from an exterior surface of the tubular member D, the tubular member straightened, foreign material is removed from the interior thereof by advancing the reamer K forwardly through the tubular member to remove fractured foreign material therefrom. During the reaming of foreign material from the interior of the tubular member D, water discharges rearwardly therein through the driving assembly E, which driving assembly has a check valve R associated therewith as shown in FIG. 6, which water serves the second function of carrying cuttings longitudinally through the tubular member to the rearward end thereof. The tubular member D is thereafter hydraulically tested as will later be described and thereafter removed from the first vehicle B. The tubular member D is raised onto the first vehicle B by use of a pair of pivotally supported first elevators T, and a second pair of like elevators U being utilized to raise a tubular member after it has been reconditioned to a position where it may roll from the first vehicle on a pair of outwardly extending arms V as shown in FIG. 1.

The tubular member D as may be seen in FIG. 1 includes a first end 10 that is forwardly disposed when the tubular member is longitudinally positioned on the first vehicle B, and a second end 12 that is rearwardly disposed when the tubular member is so mounted on the vehicle. The first vehicle B includes a chassis 14 that is defined by a pair of laterally spaced side pieces 16 that have forward and rearward cross pieces extending therebetween. The chassis also includes a rearward end piece 20 which end piece supports an upwardly extending socket 22.

Figure 2:
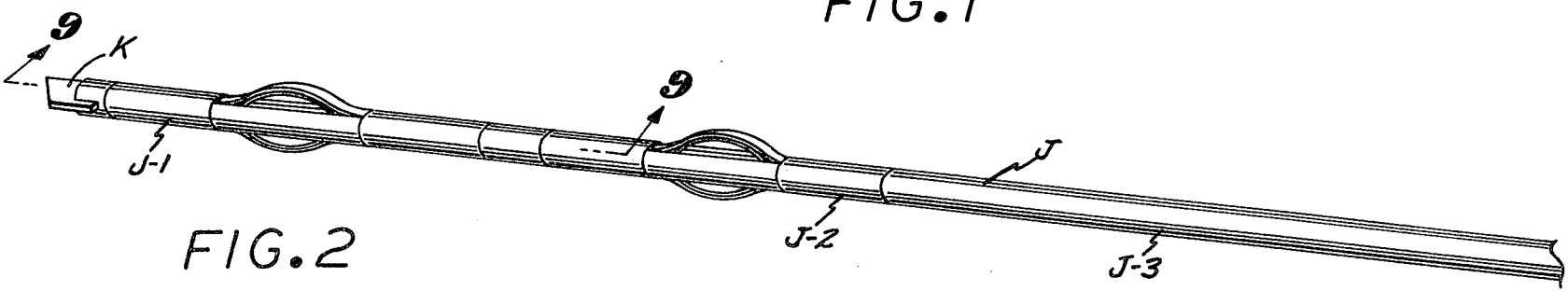
FIG. 2 is a fragmentary perspective view of the descaling unit used in removing hard foreign material from the interior of a straightened tubular member.

The forward end of the chassis 14 has an upwardly and forwardly extending frame secured thereto on which an engine M may be mounted. The tubular member D after being longitudinally positioned on the first vehicle B is removably held in a centered position thereon by two longitudinally spaced supports 26 that extend upwardly from the cross pieces 18 as illustrated in FIG. 1. The forward end of the second vehicle C has a pin 28 projecting downwardly therefrom that removably engages the upwardly extending socket 22, and is held in a locked position therein by a rotatable threaded member 30 that is disposed in a tapped bore (now shown) in the socket member 22. The first vehicle B as may be seen in FIG. 2 is supported on a first set of pneumatic tired wheels 32 and the second vehicle C on a second set of pneumatic tired wheels 34. A pair of vertically adjustable legs 36 are operatively associated with the forward ends of the first vehicle B and with these legs 36 serving to support the forward end of the vehicle at a desired elevation.

Figure 16:
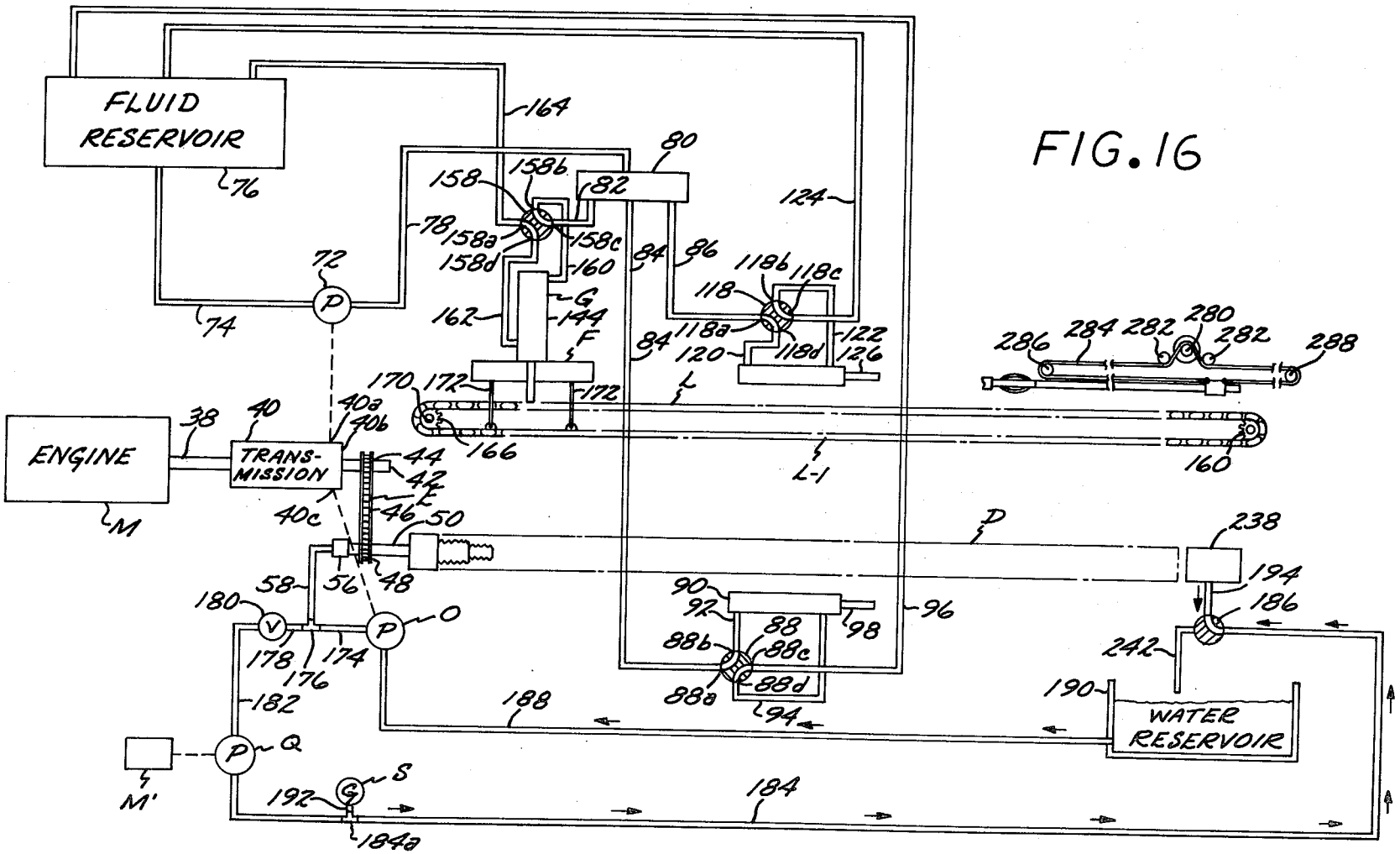
FIG. 16 is a diagrammatic view of the power means and hydraulic means used in reconditioning a tubular member when disposed in a centered position on the first vehicle of the present invention.

The engine M as may be seen in FIG. 16 has a first drive shaft 38 extending rearwardly therefrom to a transmission 40, which transmission has a number of power take-offs 40-*a*, 40-*b* and 40-*c* associated therewith. The transmission 40 also has a second rearwardly extending drive shaft 42 on which a first sprocket 44 is mounted. The first sprocket 44 is engaged by an endless link chain belt 46 that extends to a second sprocket 48 that is mounted on a heavy wall tube 50, which tube 50 is rotatably supported in two ball bearing assemblies 52 that are secured to members 54 that form a part of the chassis 14. The forward end of the tube 50 as viewed in FIGS. 6 and 16, is connected to a swivel coupling 56 that in turn is connected to a flexible conduit 58. The heavy walled tube 50 on the rearward end thereof develops into a driving head 60 that includes a forward tubular section 62 and rearward tubular section 64 that are formed with inter-engaging fingers 66 that permit limited transverse movement of the rearward tubular section 64 relative to the forward tubular section 62. The rearward tubular section 64 is rigidly secured to a threaded tubular member 68 which member has a number of longitudinally situated sections 68*a*, 68*b* and 68*c* of increasingly smaller diameters, to permit tubular members D of different diameters to be engaged by the driving head 60 by use of an internally threaded tubular connector 24. A flexible hose 70 is situated in the bore extending through the driving head 60 to prevent the leakage of water through the spaces between the engaging fingers 66, as water is discharged rearwardly through the driving head E as will later be explained in detail.

The transmission take-off 40*a*, through conventional means, drives a pump 72 that has the suction side thereof connected by a conduit 74 to a hydraulic fluid reservoir 76. The discharge side of the pump 72 through a conduit 78 is connected to a hydraulic booster 80 of conventional design, that has first, second and third fluid discharge conduits 82, 84 and 86 extending therefrom. The second conduit 84, as may best be seen in FIG. 16 is connected to a first port 88*a* of a two position valve 88, which valve includes second, third and fourth ports 88*b*, 88*c* and 88*d*. A first hydraulic cylinder 90 has first and second conduits 92 and 94 connected to the ends thereof and to the second and fourth ports 88*b* and 88*d* of valve 88. A conduit 96 extends from the third port 88*c* to the fluid reservoir 76. The first hydraulic cylinder 90 has a piston (not shown) therein that is connected to a piston rod 98 that projects rearwardly from the hydraulic cylinder.

Figure 8:
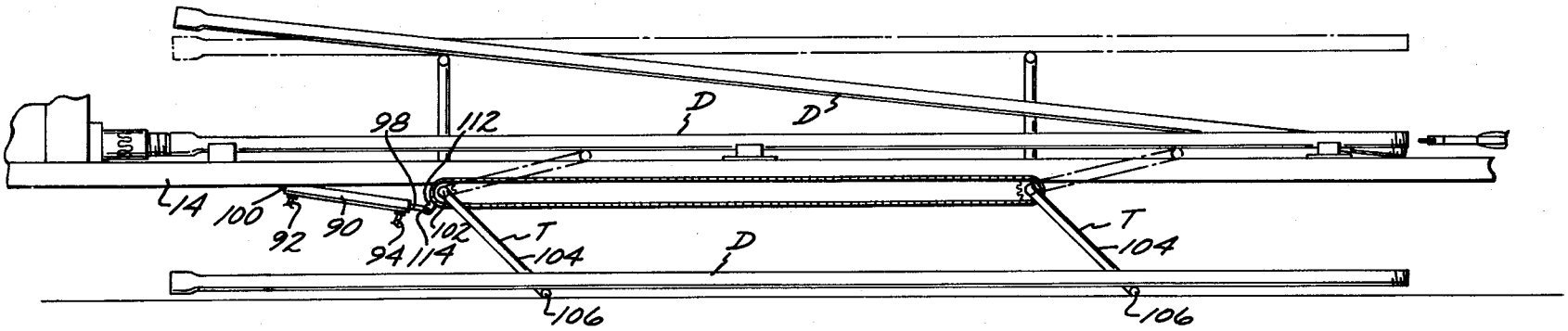
FIG. 8 is a fragmentary side elevational view of the first vehicle illustrating the manner by which first pivotally supported elevators may raise a tubular member that is to be straightened and descaled to a position where it may be rolled onto a centered position on the first vehicle, and after the tubing is straightened, descaled and hydraulically tested being raised by second elevators to be rolled onto a pair of outwardly extending arms.

In FIG. 8 it will be seen that the hydraulic cylinder 90 has the forward end thereof connected to the chassis 14 by a pivotal connection 100. Each elevator T as may best be seen in FIG. 1 includes a shaft 102 that is rotatably supported by conventional means from the chassis 14, and the shaft on its outer end having an arm 104 disposed normally thereto, and the arm on the free end including a cross-piece 106 that may serve as a support for one of the tubular members D as the latter is being raised to a position where it may be rolled onto the first vehicle A to occupy a centered longitudinally extending position thereon. Each shaft 102 has a sprocket 108 rigidly secured thereto, and the sprocket having an endless chain belt 110 extending therebetween as shown in FIG. 1. The forwardly disposed shaft 102 has a lever 112 extending outwardly therefrom which lever by a pin 114 is secured to the rearward end of the piston rod 98. When valve 88 is in the position shown in FIG. 16, hydraulic fluid will discharge through the conduit 84, ports 88*a* and 88*b*, conduit 92 into the forward interior portion of the hydraulic cylinder 90 to move the piston rod 98 rearwardly, and this movement of the piston rod in turn then rotating the forwardly disposed sprocket 108 counterclockwise. The rotation of the sprocket 108 as above-described results in the first elevator T being pivoted upwardly as viewed in FIG. 1 to position the elevators where a tubular member resting thereon may be rolled onto the first vehicle A to occupy a centered a longitudinal position thereon.

The second elevators U are of the same structure as the first elevator 10 and are actuated by the movement of a piston rod 126 that is operatively associated with second hydraulic cylinder 116. A two-position, four port valve 118 is provided that is supplied hydraulic fluid under pressure from the conduit 86 to be distributed through the conduit 120 and 122 to either the rearward or forward portions of the second hydraulic cylinder 116 to move the piston 126 either forwardly or rearwardly, with fluid in the piston discharging back to the fluid reservoir 76 through the conduit 124. Two longitudinally spaced uprights 130 are secured to the chassis 14 in longitudinal spaced relationship as shown in FIG. 1 and by pins 132 that slidably engage cavities in the upper portions of the uprights support arms V in the outwardly extending position shown in FIG. 1. After tubular member D has been reconditioned, the second elevators U are employed to raise the tubular member to an elevated position where it may be rolled from the supporting portions of the second elevators onto the arms V, where the tubular member may roll to be disposed in a stack or otherwise handled. The carriage F as may best be seen in FIG. 12 includes a platform 134 of rectangular shape, that has pairs of laterally spaced arms 136 extending downwardly and along the longitudinal sides thereof, with each pair of arms having a shaft 134 extending therebetween on which a roller 140 is mounted. The side pieces 16 are illustrated as being of L-shaped transverse cross section, although channels may be employed for the side pieces if desired. The rollers 140 rest on the horizontal legs 16*a* of the side pieces as shown in FIG. 12. An inverted U-shaped frame 142 extends upwardly from the platform 34 and a hydraulic cylinder 144 is supported in a depending position within the U-shaped frame 142. The hydraulic cylinder 144 has a piston rod 146 that is vertically movable therein, and is connected to a piston (not shown) in the cylinder. The piston rod 146 on the lower end thereof supports the pin 148 that engages the upper part of a first pressure pad H. Two second pressure pads H-1 are supported on the platform 134 with the first pad H intermediately disposed therebetween. Reinforcing members 150 extend up from the platform 134 to the vertical portions of the U-shaped frame 142 as illustrated in FIG. 13. Each of the pressure pads H and H-1 are formed from a box 152 of heavy wall structure that support four arcuate segments 154*a*, 154*b*, 154*c* and 154*d* as shown in FIG. 14.

The exterior faces of the elements 154*a*–154*d* are of arcuate transverse cross section and are of such radius as to conform generally to the exterior surface of the tubular member D. The elements 154*a*–154*d* when in pressure contact with the exterior surface of the tubular member D as it rotates are moved longitudinally relative to the rotating tubular member and frictionally engage the exterior surface of the tubular member and remove rust and corrosion therefrom as well as to deform the tubular member transversely to straighten the same. The pressure pads H-1 are of same structure as the pressure pad H but are mounted in stationary positions on the platform 134. The elements 154*a*–154*d* have pointed ends that are oppositely disposed, so that these pointed ends 156*a* and 156*b* will engage the corrosion and rust on the exterior surface of the tubular member D as the pressure pads H and H-1 move rearwardly on the chassis 14 of the apparatus A, and the pointed ends 156*a* and 156*b* serving a like function as the pressure pads H and H-1 move forwardly on the tubular member. In FIG. 16 it will be seen that the first conduit 82 extends from the booster 80 to a valve 158, which is of a two position, four port type, and when the valve is disposed as shown in FIG. 16 fluid may flow through a conduit 160 from the second port 158*b* to the upper portion of the hydraulic cylinder G to force pad H downwardly into pressure contact with tubular member D. Fluid in the lower portion of hydraulic cylinder G will flow upwardly through a conduit 162, port 158*d* and 158*a* to a conduit 164 to return to the fluid reservoir 76. When the valve 158 is in a second position the flow of hydraulic fluid under pressure thereto is reversed and the pressure pad H is moved upwardly relative to the tubular member D. The first endless chain belt L, as can best be seen in FIG. 16, extends between a forwardly disposed sprocket 166 that is mounted on a shaft 170 that is driven by the power take-off 40*b* from the transmission 40. The platform F is connected by downwardly depending members 172 to the lower reach L-1 of belt L as shown in FIG. 16. When the sprocket 166 is driven in a counterclockwise direction, the lower reach L-1 of the belt L is moved rearwardly, and with a desired force being exerted by the pressure pads H H-1 on the tubular member D by manipulation of the valve 158.

The pump O is illustrated in FIG. 16 as being driven by the power take-off 40*c* of transmission 40. The pump P has the discharge side thereof connected to a conduit 174 that extends to a tee 176 and this tee having one leg thereof connected to the conduit 58. The tee 176 has another leg connected to a conduit 178 that extends to a valve 180, and this valve having a conduit 182 connected thereto. The suction side of pump O is connected by a conduit 184 to a water reservoir 190. When pump O is energized, water is discharged therefrom through conduit 174, tee 176, conduit 158 into the driving assembly E to flow therethrough into the interior of the tubular member D to wash cuttings rearwardly therein when the tubular member D is being reamed as will later be described. The pump Q illustrated in FIG. 16 is of a high pressure type and is preferably driven by an independent prime mover M′ or by a take-off (not shown) from the transmission 40. The pump Q has the suction side thereof connected to the conduit 182 and the discharge to a conduit 184 that extends to the two-position valve 186 illustrated in FIG. 16. The suction side of the pump O is connected by a conduit 188 to the water reservoir 190 as shown in FIG. 16. The conduit 184 has a tee 184*a* therein which has one leg connected by a conduit 192 to the pressure gauge S. When the valve 186 is in the position shown in FIG. 16, fluid discharges therefrom under high pressure to a conduit 194 for hydraulically testing the tubular member D as will later be explained.

Figure 9:
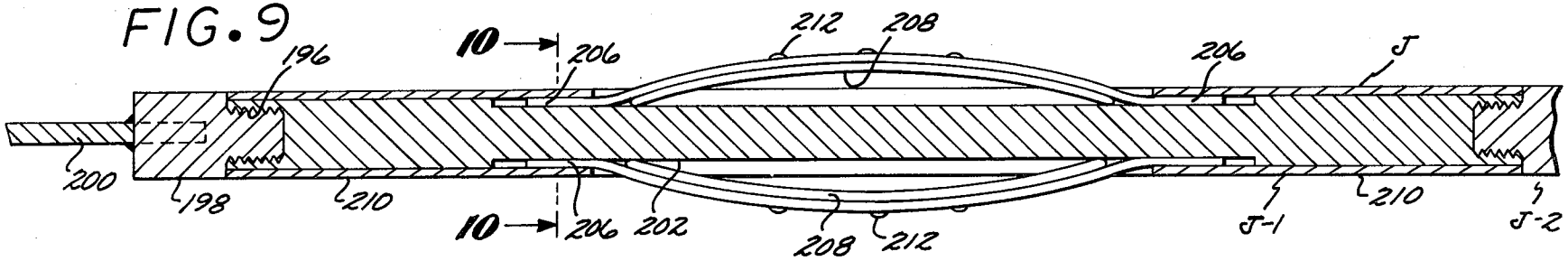
FIG. 9 is an enlarged longitudinal cross sectional view of the forward portion of a first form of descaling unit that is used in removing fractured foreign material from the interior of a tubular member.
Figure 11:
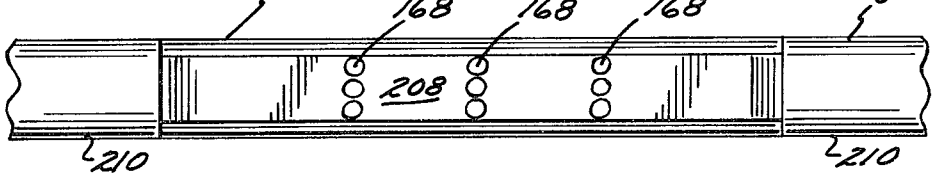
FIG. 11 is a fragmentary top plan view of a portion of the first form of descaling unit that illustrates both the spring that forms a part thereof and the support for the spring.
Figure 10:
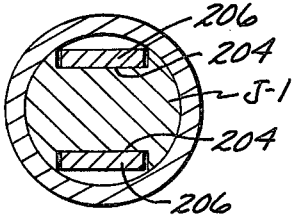
FIG. 10 is a transverse cross sectional view of the first form of descaling unit shown in FIG. 9 taken on the line 10—10 thereof.

The first form of elongate element J illustrated in FIGS. 9 and 2 is used for reaming fractured foreign material from the interior of tubular members D when there is a longitudinal passage in the foreign material through which water may flow rearwardly. Element J is formed from a number of elongate sections J-1, J-2, and J-3. The section J-1, as can be seen in FIG. 9, has internally threaded cavity 196 in the forward end thereof that is engaged by a threaded plug 198 that supports a reamer blade 200 on the forward end thereof. Both the sections J-1 and J-2 have recessed intermediate portions 202 formed therein and which recessed portions include oppositely disposed longitudinally extending flat faces 204. The faces 204 are in abutting contact with flat end pieces 206 of a bow spring 208 as shown in FIG. 9, and the flat portions being removably held in abutting contact with the flat surfaces 204 by sleeves 210 shown in FIG. 9. The bow springs have a number of longitudinally spaced groups of hardened metal beads 168 extending outwardly therefrom. The first form of elongate element J has threads formed on the rearward end of section J-3 that engage a tapped bore 252 in a body 250 shown in FIG. 18. The first form of element J is used in reaming fractured foreign material from the interior of a tubular member D when there is a passage in the tubular member through which water can flow rearwardly.

Figures 17, 18, 19, 20:
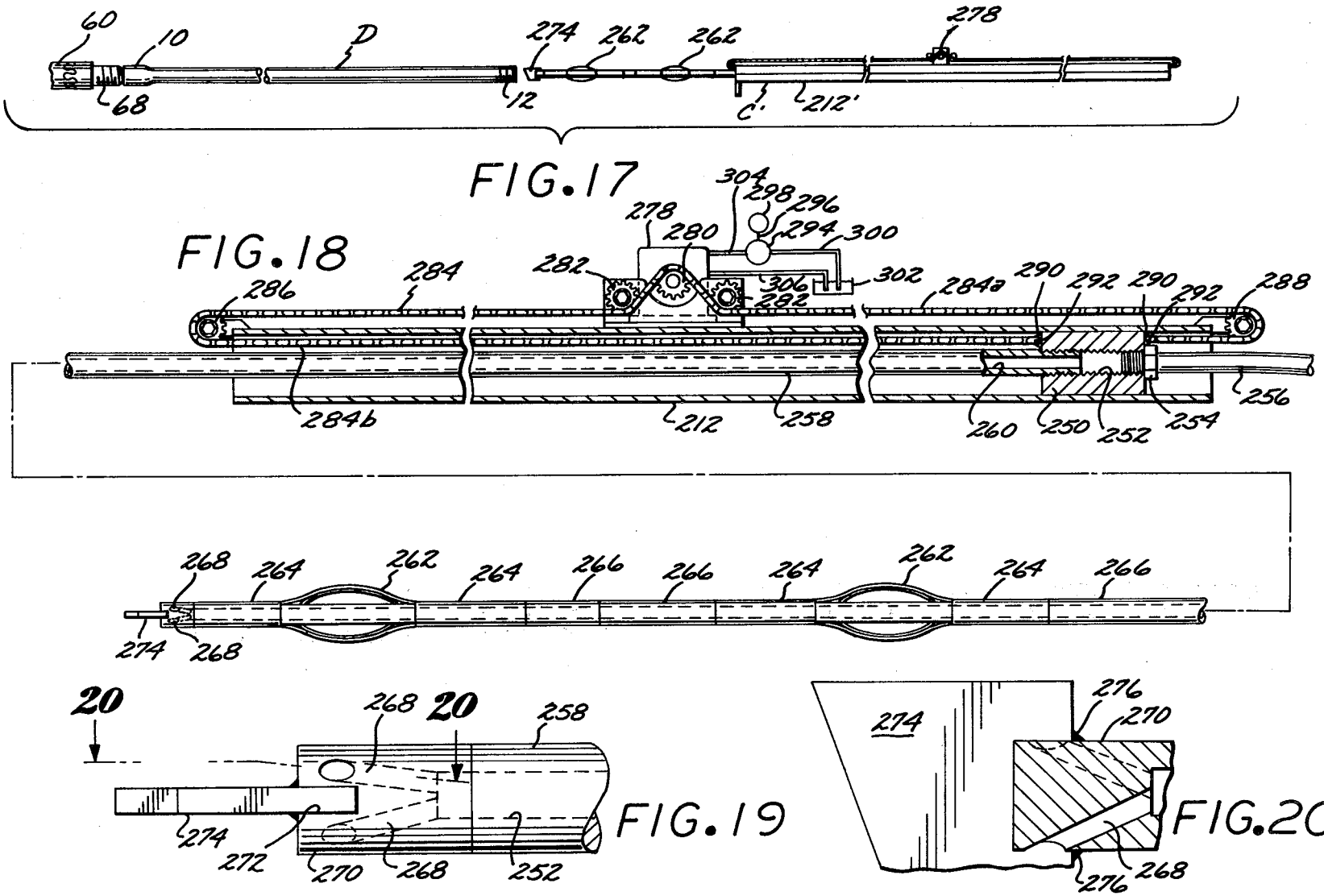
FIG. 17 is a side elevational view of a portion of a second vehicle that may be used with the first vehicle to ream the interior of an elongate tubular member.
FIG. 18 is an enlarged longitudinal cross-sectional view of a portion of the second vehicle.
FIG. 19 is a side elevational view of the forward portion of a second form of reaming unit that is particularly adapted for use in removing a solid concrete core from a tubular member.
FIG. 20 is a top plan view of the second form of reamer unit shown in FIG. 19.

The second vehicle C, shown in FIGS. 1 and 17 to 20, may be used with either the first form of reamer assembly J shown in FIGS. 2, 3 and 4 and 9 or the second form J-1 illustrated in FIGS. 18 to 20.

The second vehicle C includes an elongate shell 212 is supported in a substantially horizontal position by a downwardly extending frame 214 that have the second pair of pneumatic tired wheels 34 rotatably mounted thereon. The shell 212 is of non-circular transverse cross section.

Shell 212 has a block 250 of non-circular transverse cross-section slidably mounted therein, which block has a tapped bore 252 extending longitudinally therethrough. The rearward end of bore 252 is engaged by a threaded fitting 254 that is connected to a flexible hose 256 that extends to a source of water (not shown). An elongate rigid heavy walled tubular element 258 is provided that has a rearward threaded end that engages the tapped bore 252. Element 258 has a longitudinal passage 260 therein.

Element 258 that forms a part of the second form of element J-1 shown in FIGS. 1, 8, 19 and 20, has a number of longitudinally spaced bow springs 262 mounted on the exterior thereof and removably held in place thereon by tubular sleeves 264. Sleeves 264 are prevented from moving longitudinally on tube 258 by tubular spacers 266.

Element 258 has a solid forward end 270 in which a number of angularly disposed second passages 268 are formed that are in communication with passage 260. Solid end 270 has a longitudinal slot 272 therein in which the rearward end portion of a reamer blade 274 is disposed, and is permanently held in position therein by spot welds 276.

A hydraulic motor 278 is mounted on the upper central portion of shell 212 and includes a driving sprocket 280. The motor 278 rotatably supports two idling sprockets 282 on opposite sides of the driving sprocket 280. The sprockets 280 and 282 are engaged by an endless chain link belt 284 that has an upper reach 284*a* and lower reach 284*b*. Shell 212 rotatably supports a sprocket 286 on the forward end thereof and a sprocket 288 on the rearward end thereof. Block 250 has forward and rearwardly extending lugs 290 secured that have the free ends of the lower belt reach 284*b* secured thereto by pins 292.

A pump 294 is provided that by a drive shaft 296 is driven by a reversible prime mover 298. The suction side of pump 294 has a conduit 300 extending therefrom to a reservoir 302. The discharge side of pump 294 is connected by a conduit 304 to hydraulic motor 278. Fluid discharged from motor 278 flows through a conduit 306 to reservoir 302.

By actuating the prime mover 298 the block 250 may be moved selectively either rearwardly or forwardly in the shell 212. The first form of element J shown in FIGS. 2, 3, 9, 10 and 11 so removably connected to block 250 by having the rear threaded end of section J-3 energize the tapped bore 252 of block 250. First form of element J is used with a tubular member D that has an annulus shaped layer of foreign material within the interior thereof that has been fractured by the straightening operation performed on the tubular member as previously described. When the first form of element J is used the stream of low pressure water from the driving assembly E flows rearwardly through the tubular member D to carry cuttings of the foreign material therewith, which water and cuttings discharge from the rearward open end of the tubular member.

Figure 3:
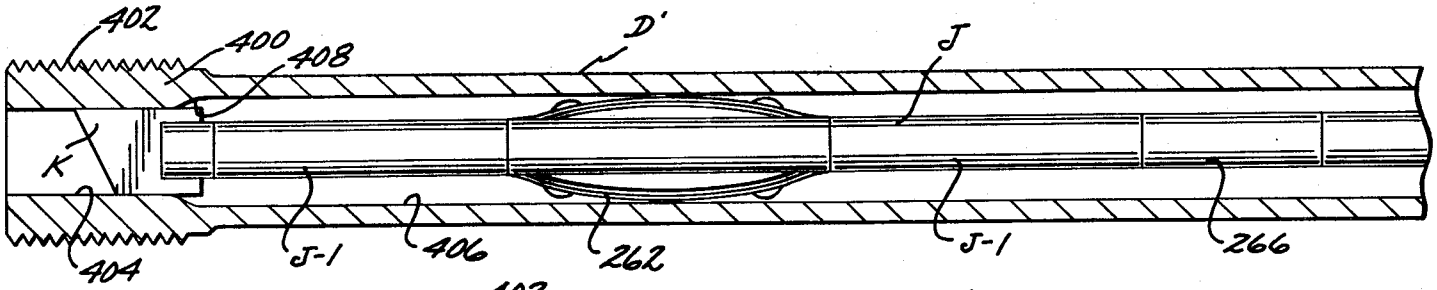
FIG. 3 is a longitudinal cross sectional view of upset oil well tubing that has the descaling unit moving longitudinally therethrough.
Figure 4:
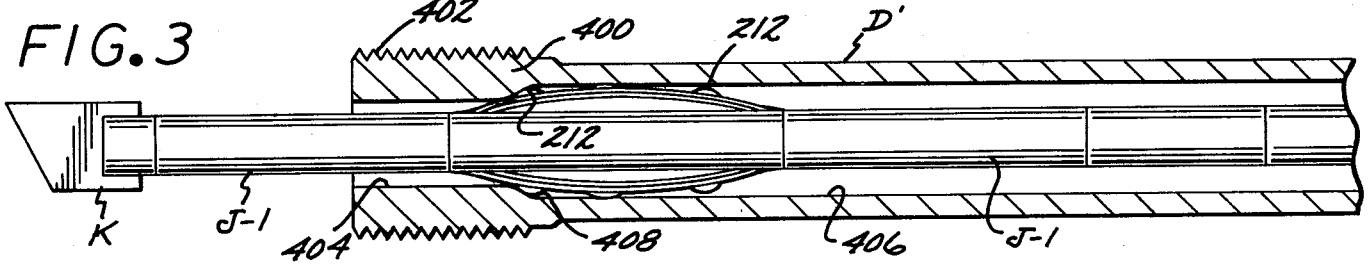
FIG. 4 is the same view as shown in FIG. 3 that illustrates the manner by which foreign material is descaled from an interior shouldered portion of the tubular member.

In FIGS. 3 and 4 the tubular member D is shown as upset tubing D′ which has heavy walled end portions 400 that have external threads 402 and a bore 404 extending therethrough that is of smaller diameter than the bore 406 of the upset tubing between the end portions. The bores 404 and 406 at their junction define ring-shaped body shoulders 408. The blade K is of such width that it may slide through the bore 404, but will not be in reaming contact with the interior surface defining the bore 406. Foreign material is removed from the surface of the bore 406 due to the bow springs 208 maintaining the hard beads 212 in scraping contact therewith. At least one set of hard beads 212 is so disposed longitudinally on bow springs 208 that they contact body shoulders 408 and remove foreign material therefrom as the first form of element J is advanced through the upset tubing D′. When the first form of element J is used no water is discharged into the tapped bore 252 of block 250 from hose 256.

The second form of the element J′ is used when the tubular member D has a solid concrete core therein, with water being supplied to the blade 274 through the passages 268 and 252 as may be seen in FIGS. 19 and 20. The operation of the invention is as follows. The length of pipe D to be straightened is rolled onto the cross pieces 106 when they are in the downward position as shown in FIG. 1. The endless belts B are now driven to pivot the elevators T upwardly in a counter-clockwise direction as viewed in FIG. 1 to a position where the pipe may be rolled from the cross pieces onto the bed of the first vehicle B. The driving assembly E is now power rotated, and as the pipe D is manually moved longitudinally on the bed the first end 10 of the pipe will engage one of the tubular members 68*a*, 68*b* or 68*c* of the driving assembly E as may be seen in FIG. 4.

The driving assembly E is now driven by the motor M as shown in FIG. 16. By driving endless belt L shown in FIG. 16 the carriage F and hydraulic assembly G are moved longitudinally on first vehicle B away from the driving assembly E. The hydraulic assembly G is actuated to apply a force of substantial magnitude to the section of the pipe D situated between the pressure pads H and H-1 which pads are shown in FIG. 12. As the carriage F and hydraulic assembly G move longitudinally along the bed of first vehicle A, the force exerted by the pads H and H-1 removes rust from the exterior of the pipe D and sequentially straightens the same. The above-described operation, due to friction of the pads H and H-1 with the pipe D generates substantial heat, and to the extent that the metal defining the pipe could be damaged as a result thereof. To minimize such a build up in temperature, the pump O is driven to supply cooling water to the interior of the pipe D through conduit 58 and coupling 56, both of which are shown in FIG. 16.

During the straightening operation any hard scale or cement in the interior of pipe D is fractured due to the sequential transverse flexing of the pipe sections between the pair of pressure pads H-1.

After the pipe D has been straightened the carriage F is returned to a position adjacent the driving assembly E. The driving sprocket 280 is now driven to rotate belt 284 shown in FIG. 16 and advance the elongate element J and reamer blade 274 longitudinally through the interior of pipe D towards driving assembly E. During the above-described reaming operation the pipe D is rotated, and water from conduit 58 is discharged into the interior of the pipe to carry the cuttings rearwardly therein to discharge from the second end 12 of the pipe. The threads on the second end 12 of pipe D are cleaned by use of a brush N shown in FIG. 1.

The elongate element J is now withdrawn from pipe D. The second end 12 of the pipe D is now connected to the cup-shaped member 238 shown in FIGS. 1 and 16. The pump Q is now actuated to supply high pressure water to the interior of pipe D through conduit 184 when valve 186 is in the first position shown in FIG. 16. The interior of the pipe D is subjected to a desired pressure which is indicated on gauge S shown in FIG. 16. After the pipe has been hydraulically tested the valve 186 is disposed in a second position to permit water to discharge therethrough to a reservoir 190 shown in FIG. 16. The pipe D is now rotated in a direction to disengage the second end 12 from cup-shaped member 238. The pipe is now manually held in a stationary position by a wrench or the like (not shown) and the driving head E rotated in a direction to disengage it from the first end 10 of the pipe. The driving head E includes a check valve R to prevent high pressure testing water from flowing through the driving head to the conduit 58.

The second elevators U are now used to raise the straightened, cleaned and hydraulically tested pipe D to an elevated position where it may be rolled therefrom onto the arms V shown in FIG. 1. The pipe D may be rolled from the arms V, and thereafter stored in a suitable rack (not shown) or returned for use on an oil well.

The cup-shaped member 238 is supported from a transverse platform 232 that by rollers 234 is longitudinally movable on the rearward portion of the bed of first vehicle B as shown in FIG. 1. The cup-shaped member 238 includes a rotatable internally threaded portion **238*a* that removably engages the second threaded end 12 of pipe D. Cup-shaped member 238 is is communication with an upwardly extending tube 236 which in turn is in communication with the valve 186, to permit high pressure water to be discharged to the interior of pipe D during the hydraulic testing of the latter. A tubular guide 240 is supported from cup-shaped member 238 and rotatably supports the second end 12** of pipe D during the reaming operation of the latter.

The use and operation of the invention has been described previously in detail and need not be repeated.

What is claimed is:

1. An apparatus that includes an elongate bed having a forward and a rearward end on which an elongate metallic tubular member having a forward threaded end and a rearward threaded end may be removably supported in a longitudinally extending position to be straightened, have products of corrosion removed from the exterior surface thereof, and hydraulically tested to a desired pressure prior to being moved from said position, said apparatus including:

a. first means for removably supporting said tubular member in said longitudinal position on said bed;

b. a driving assembly for removably engaging said forward end of said tubular member when the latter is disposed in said longitudinal position to rotate said tubular member;

c. a power operated carriage longitudinally movable on said bed;

d. second power operated means on said carriage for pressure and frictionally engaging sequential sections of said tubular member as said tubular member rotates on said bed to straighten said tubular member by transversely deforming said sections and remove products of corrosion from the exterior surface by frictional contact therewith;

e. third means for discharging a stream of low pressure water through a passage in said driving assembly into said forward end of said tubular member, with said stream of water discharging from the rearward end of said tubular member and maintaining said tubular member at a sufficiently low temperature during said straightening and product of corrosion removing operation that the physical characteristics of the metal defining said tubular member are not impaired;

f. fourth means for preventing said water discharging from said forward end of said tubular member;

g. fifth means for removably sealing said rearward end of said tubular member when the latter is stationary and said tubular member at least partially filled with said low pressure water after being so sealed;

h. sixth power operated means for discharging high pressure water into said tubular member to completely fill the same and subject the interior of said tubular member to a predetermined pressure;

i. seventh means in communication with the interior of said tubular member to indicate when said predetermined pressure has been reached; and j. first power means for selectively actuating said driving assembly, power operated carriage, second power operated means and sixth power operated means.

2. An apparatus as defined in claim 1 which in addition includes:

k. eighth means that loosely and removably engage said rearward end of said tubular member when the latter is disposed in said longitudinal position to prevent appreciable lateral movement of said rearward end as said tubular member rotates.

3. An apparatus as defined in claim 1 in which said second power operated means includes an upwardly disposed pressure pad and two laterally spaced lower pressure pads, said upper pressure pad being intermediately disposed between said lower pressure pads.

4. An apparatus as defined in claim 3 in which said upper pad and lower pressure pads have pointed rearwardly extending end portions that sever said products of corrosion from the exterior surface of said tubular member as said carriage moves rearwardly relative thereto.

5. An apparatus as defined in claim 1 in which said driving assembly includes a plurality of thread defining portions of different diameters that are removably connectable to forward threaded end portions of tubular members of different diameters when one of said tubular members is disposed on said bed.

6. An apparatus as defined in claim 5 in which said plurality of thread defining portions are angularly adjustable relative to the balance of said driving assembly.

7. An apparatus as defined in claim 1 that in addition includes:

k. wheel means for movably supporting said bed, with said bed and wheel means cooperating to define a first vehicle.

8. An apparatus as defined in claim 7 that in addition includes:

l. a second wheel supported vehicle that includes a longitudinally extending shell of non-circular transverse cross section;

m. eighth means for removably connecting said second vehicle to the rearward end of said first vehicle, with said shell coaxially aligned with said tubular member on said first vehicle;

n. a block of non-circular transverse cross section slidably movable in said shell;

o. an elongate element extending forwardly from said block, said element having a forward end;

p. a reamer blade supported from said forward end of said element which blade has a pair of longitudinal edges;

q. a plurality of bow springs supported from said element rearwardly of said blade, said bow springs extending outwardly from said element a greater distance than said longitudinal edges and greater than the radius of the interior of said tubular member; and r. second power operated means for moving said block and element forwardly and rearwardly relative to said shell, with said element when moved forwardly reaming fractured foreign material from the interior of said tubular member by said blade engaging centrally disposed portions of said foreign material and said bow springs engaging outwardly disposed portions of said foreign material clinging to the interior side wall of said tubular member.

9. An apparatus as defined in claim 8 which in addition includes:

s. a plurality of buttons of a hard metal bonded to the exterior surfaces of said bow springs that ream foreign material from the interior surface of said tubular member.

10. An apparatus as defined in claim 9 in which said tubular member is upset oil well tubing that has heavy walled end portions in which longitudinal first bores are defined that are of smaller diameter than an intermediate second bore that extends therebetween, said first and second bores at their junctions defining annulus interior body shoulders, with said blade of said width as to be longitudinally movable through said first bores, with at least a portion of said buttons being so longitudinally spaced on said bow springs as to scrape said foreign material from the side wall defining said second bore as well as said body shoulders prior to said bow springs deforming to pass through said first bores.

11. An apparatus as defined in claim 8 in which block has a bore extending longitudinally therethrough that is in communication with a passage in said element that has at least one discharge opening adjacent said blade and said apparatus in addition including:

s. ninth means for discharging water to said bore to flow through said passage and exit from said discharge openings to cool said blade and bow springs, with said water after discharge flowing rearwardly to carry reamed cuttings of foreign material therewith that discharge from said tubular member at said rearward end thereof.

12. An apparatus as defined in claim 1 in which said fourth means is a check valve in said passage in said driving assembly.

13. An apparatus as defined in claim 8 in which said second power operated means includes:

s. a hydraulic motor mounted on said shell, said motor having a fluid inlet and outlet said motor including a driving sprocket;

t. a first pair of sprockets rotatably supported from said motor on opposite sides of said driving sprocket;

u. a second pair of sprockets rotatably supported on opposite ends of said shell;

v. an endless link chain belt that engages said driving sprocket, and said first and second pairs of sprockets, and said belt extending through said shell and rigidly connected to said block;

w. a hydraulic fluid reservoir;

x. a pump having an inlet and an outlet;

y. a reversible prime mover that drives said pump;

z. first conduit means that connect said pump inlet to said reservoir and said pump outlet to said motor inlet; and aa. second conduit means that connect said motor outlet to said reservoir, with said prime mover when rotating said driving sprocket in a first direction moving said block towards said first vehicle and said driving sprocket when rotating in a second direction moving said block away from said first vehicle.

* * * * *